United States Patent [19]

Dallot

[11] Patent Number: 4,605,027

[45] Date of Patent: Aug. 12, 1986

[54] APPARATUS FOR CLEANING A LINEAR OBJECT IN A SOLVENT MEDIUM

[75] Inventor: Mario Dallot, Annemasse, France

[73] Assignee: Ultrasons Annemasse, Annemasse, France

[21] Appl. No.: 595,824

[22] Filed: Apr. 2, 1984

[30] Foreign Application Priority Data

Apr. 1, 1983 [FR] France ..... 83 05649

[51] Int. Cl.[4] ..... B08B 3/12

[52] U.S. Cl. ..... 134/108; 134/109; 134/122 R; 134/184; 68/3 SS; 68/18 C; 68/175

[58] Field of Search ..... 134/1, 9, 11, 12, 15, 134/64 R, 64 P, 108, 109, 122 R, 122 P, 184; 68/3 SS, 5 E, 18 R, 18 C, 175, 181 R, DIG. 1

[56] References Cited

U.S. PATENT DOCUMENTS

| | | | |
|---|---|---|---|
| 2,153,577 | 4/1939 | Levine | 134/109 X |
| 2,270,642 | 1/1942 | Somes | 134/109 X |
| 2,947,595 | 8/1960 | Moelter . | |
| 3,099,584 | 7/1963 | Walsh | 134/1 |
| 3,968,013 | 7/1976 | Boynton | 134/108 X |

FOREIGN PATENT DOCUMENTS

| | | | |
|---|---|---|---|
| 2362011 | 6/1975 | Fed. Rep. of Germany | 68/3 SS |
| 2296025 | 7/1976 | France | 134/108 |
| 2313136 | 12/1976 | France | 134/108 |

*Primary Examiner*—Philip R. Coe

*Attorney, Agent, or Firm*—Burns, Doane, Swecker & Mathis

[57] ABSTRACT

An apparatus for cleaning a continuous, long, linear object in a solvent medium includes an inlet ramp and an outlet ramp for the object, and a tubular guide open at its ends for guiding the long, linear object. The object moves inside the tubular guide along an imposed trajectory in the form of a continuous curve. The tubular guide is provided, adjacent one end, with an inlet for clean solvent medium and, adjacent the other end, an outlet for dirty solvent medium. The solvent medium circulates through the tubular guide in contact with the long, linear object in the opposite direction to the direction of movement of the object through the tubular guide. A device for subjecting the solvent medium to ultrasound is also included. The apparatus is particularly intended to be used for cleaning filiform objects, objects in the form of a strip or objects consisting of unit elements joined together to form a strip.

7 Claims, 5 Drawing Figures

Fig. 1
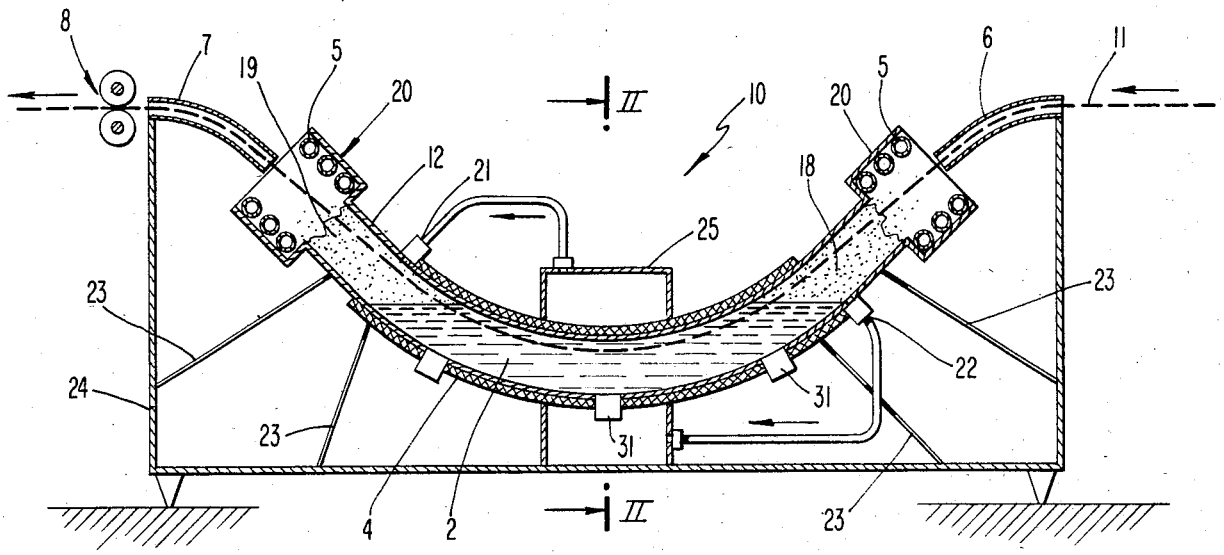
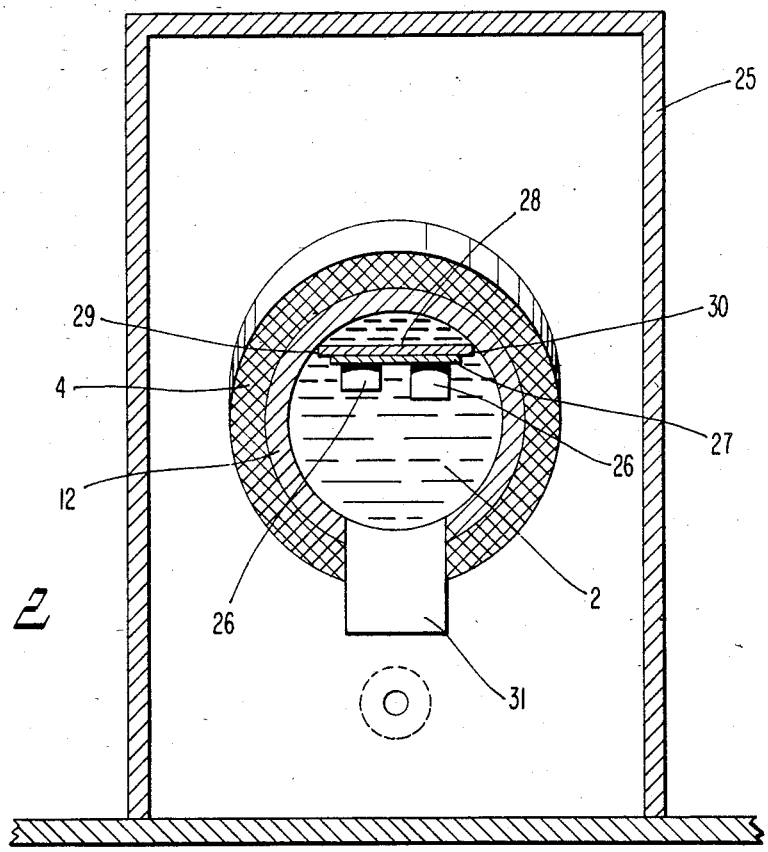
Fig. 2

APPARATUS FOR CLEANING A LINEAR OBJECT IN A SOLVENT MEDIUM

BACKGROUND OF THE INVENTION

The present invention relates to an apparatus for cleaning at least one continuous, long, linear object in a solvent medium. It also relates to the use of such an apparatus to clean at least one continuous, long, linear object.

In the present text, the term "continuous, long, linear object" is understood to mean an object of generally elongate shape, the longitudinal dimension of which is large compared with the dimensions of the object in a cross-section through a plane approximately perpendicular to the longitudinal dimension.

The continuous, long, linear objects in question are not rigid; they are substantially flexible and can be wound onto reels or into rolls.

Thus, the term "continuous, long, linear object" can denote a filiform object, an object in the form of ribbon, or an object consisting of unit elements joined together by suitable means to form a strip.

Examples of such continuous, long, linear objects that are intended to be cleaned by means of the present invention include filaments, threads and cables, for example made of metal, from which any trace of dirt must be removed, metal ribbons, magnetic tapes and photographic films, and electronic components soldered onto printed circuits (from which any trace of soldering flux must be removed) that are placed side-by-side and joined, for example by a support, to form a long, linear object having the appearance of a strip.

In the present text, the term "solvent medium" is understood to mean a liquid which contains at least one substance capable of bringing at least one other substance into solution. Thus, the solvent medium might be a fluorinated solvent or it can contain, for example, at least one organic and/or inorganic solvent or can alternatively be an alkaline or acid solution.

Apparatuses for cleaning objects of the previously mentioned types generally work by immersion of the object in the solvent medium. These apparatuses most frequently consist of an open vat having an inlet ramp and an outlet ramp in the region of its opening. The vat contains a liquid solvent medium that is chosen for its ability to dissolve the dirt present on the object. The solvent medium is generally heated, sometimes to a boil, and frequently subjected to the action of ultrasound up to the point of cavitation, which facilitates the extraction of dirt that is insoluble in the solvent medium. The liquid solvent medium is sometimes surmounted by a zone of hot saturated vapor of the solvent medium, and condensing means are provided in the top of the vat in order to prevent the vapor from escaping.

In an apparatus in which the solvent medium is surmounted by a zone of hot vapor, the long, linear object to be cleaned is moved through the vat in such a way as to pass successively through the vapor zone, the solvent medium and the vapor zone again. When the object passes through the vapor zone for the first time, it is preheated as a result of the vapor condensing on its surface. This action inhibits thermal shock to the object which is immersed in the hot solvent medium. Further, the object is pre-cleaned by the trickles of condensate. When the object passes through the vapor zone for the second time, it is rinsed by the trickles of solvent that has condensed on it.

In general, the object is moved through the vat by exerting a pulling force on it using drawing means, such as a means for winding the object into a roll. Whether or not the liquid solvent medium is surmounted by a vapor zone, the object moves through the vat along a trajectory and at a speed which are such that the residence time of the object in the solvent medium is sufficient to ensure that the object is properly cleaned.

In some apparatuses, the object moves along a free trajectory between the inlet ramp and the outlet ramp and, in the case where the object is moving too fast, there is nothing to prevent the object from following too short a path through the solvent medium or even from coming out of the medium. To overcome this disadvantage, some apparatuses are provided with rollers that freely rotate around their axes, and the long, linear object then moves through the solvent medium along a broken-line trajectory.

An apparatus of this type prevents any inopportune emergence of the long, linear object from the solvent medium, but the rollers considerably increase the risks of damaging the long, linear object. In the case of cleaning electronic circuits, this damage can even extend to pulling the components off.

Furthermore, as the solvent medium is frequently caustic, especially when it is being subjected to cavitation, there are considerable problems of corrosion of the rollers and their supports.

OBJECT AND BRIEF STATEMENT OF THE INVENTION

One object of the invention is to provide an apparatus for cleaning a continuous, long, linear object in a solvent medium which prevents any inopportune emergence of the object from the solvent medium while at the same time preventing any damage to the object.

In accordance with the present invention, an apparatus for cleaning at least one continuous, long, linear object in a solvent medium comprises inlet and outlet ramps for the object, an open tubular guide for guiding the long, linear object, with the object moving inside the tubular guide along an imposed trajectory in the form of a continuous curve. One end of the tubular guide is provided with inlet means for clean solvent medium and the other end of the guide is provided with outlet means for dirty solvent medium so that the solvent medium circulates through the tubular guide in contact with the long, linear object in the opposite direction to the direction of movement of the object through the tubular guide. Means for subjecting the solvent medium to ultrasound are also provided.

For the sake of convenience, the object is described as being moved along a trajectory having the form of a continuous curve, that is to say a curve without points of retrogression. Strictly speaking, each point of the object moves along its own trajectory, with all the trajectories following from one another. The continuous curve forming the trajectory of the object is such that its concavity faces the surface of the solvent medium. The shape of the tubular guides is such that they make it possible to impose a trajectory in the form of a continuous curve on the object, the concavity of which curve faces the surface of the solvent medium.

Advantageously, the tubular guides are made of a material which is very resistant to corrosion by the solvent medium, to wear due to the rubbing of the object, and also to erosion due to the cavitation of the solvent medium when it is subjected to ultrasound action. Depending on the long, linear object to be cleaned and the solvent medium, the tubular guides can be made, for example, of plastic, stainless steel, glass, ceramic, porcelain or the like.

The cross-section of the tubular guides through a plane perpendicular to the direction of movement can have any shape. Preferably, the shape of the cross-section is chosen so as to prevent any lateral movement of the object. A tubular guide of this type can have, for example, a square, rectangular, circular or elliptical cross-section.

In one embodiment of the invention, the dirty solvent medium leaving the tubular guide can be directed towards a regenerating device, for example a distiller, be cleaned therein, and then be re-introduced into the tubular guide by the inlet means.

In another embodiment, the invention includes an open vat containing a liquid medium, and the tubular guide is partly immersed in the liquid medium so that its ends are located above the surface of the liquid medium in the vat. Preferably, the liquid medium contained in the vat is solvent medium and the inlet means for clean solvent medium entering the tubular guide is at a greater height than the outlet means for dirty solvent medium and located above the surface of the solvent medium. The dirty solvent medium can flow directly into the vat.

The means for subjecting the solvent medium to ultrasound can consist of emitters immersed in the solvent medium itself. Preferably, the ultrasonic emitters are fixed to the wall of the tubular guide or of the vat in the manner disclosed in French Pat. No. 1,526,179, for fixing a piezoelectric transducer to a thin wall. The ultrasound is transmitted to the solvent medium either directly or via the liquid medium.

Advantageously, the apparatus according to the invention is such that it includes means for heating the solvent medium. The means for heating the solvent medium can be, for example, electrical heating means or heating means which employ the circulation of a heat-transfer fluid. Electrical heating means can consist, for example, of elements immersed in the solvent medium or fixed to the wall of the tubular guide or the vat. Heating means utilizing the circulation of a heat transfer fluid can consist, for example, of a coil immersed in the solvent medium or of a jacket around part of the wall of the tubular guide or the vat.

Depending on the objects to be cleaned and the nature of the solvent used, the solvent medium may be heated to a boil. In this case, the apparatus is such that it is provided with means for condensing the vapors of the solvent medium. For an apparatus in which the solvent medium is contained in the tubular guide, the means for condensing the vapors of the solvent medium can be, for example, a coil through which a cooling fluid, such as water, passes and which is placed on the inner face of the wall of the tubular guide. Alternatively a sleeve through which a cooling fluid passes and which is fixed to the outer face of the wall of the tubular guide can be utilized.

For an apparatus in which the solvent medium is contained in a vat, the means for condensing the vapors of the solvent medium can be, for example, a coil through which a cooling fluid, such as water, passes and which is placed on the inner face of the wall of the vat, in the region of its opening.

Advantageously, the inlet means for the clean solvent medium is connected to means for recovering the condensate of the vapors of the solvent medium. Preferably, the apparatus according to the invention also includes, between the means for recovering the condensate of the vapors of the solvent medium and the inlet means for the clean solvent medium, a water separating device and a condensate heating device.

In order to have a sufficienct quantity of vapor of the solvent medium, the vat containing the solvent medium advantageously consists of a cleaning compartment in which the tubular guide is partly immersed in the solvent medium and a compartment for distilling the solvent medium, which is provided with means for heating the solvent medium. The partition between the cleaning compartment and the distillation compartment has an overflow sill and an opening to conduct the vapors of the solvent medium into the cleaning compartment.

An apparatus which makes it possible to simultaneously clean several objects also forms part of the invention. An apparatus of this type has several inlet and outlet ramps for objects and several tubular guides placed side-by-side with no common points, or alternatively joined side-by-side with two adjacent tubular guides possessing a common wall portion.

The apparatus forming the subject of the invention can be used for cleaning at least one filiform, long, linear object such as a thread, a filament or a cable. It can also be used for cleaning at least one, long, linear object in the form of a strip.

The invention is more particularly intended to be used for cleaning at least one long, linear object consisting of unit elements joined together, for example by a support, to form a strip. Unit elements of this type can be electronic components soldered onto printed circuits.

The invention will be more readily understood from the following description of the accompanying figures, which schematically illustrate various embodiments of an apparatus for cleaning at least one long, linear object in a solvent medium which forms the subject of the invention.

BRIEF DESCRIPTION OF THE DRAWINGS

FIG. 1 is a view in section through the plane of symmetry of the tubular guide of one embodiment of an apparatus according to the invention.

FIG. 2 is a sectional view through the plane II—II of the tubular guide of the apparatus shown in FIG. 1.

DESCRIPTION OF THE ILLUSTRATED EMBODIMENTS

Figure 3:
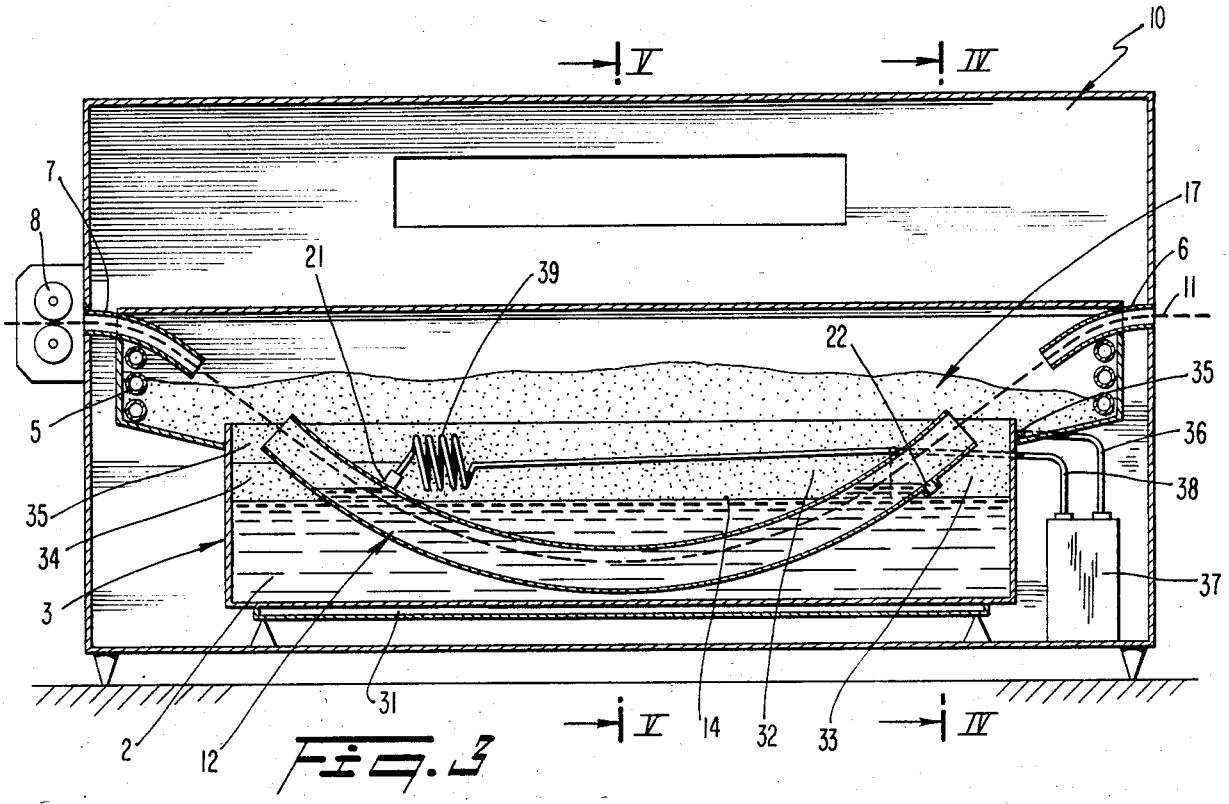
FIG. 3 is a general view in section through the plane of symmetry of the tubular guide of another embodiment of the invention.

In the embodiment shown in FIG. 1, an apparatus (10) for cleaning a long, linear object in a solvent medium includes an inlet ramp (6), an outlet ramp (7) and a device (8) for drawing the long, linear object (11). The device can consist, for example, of two rollers that are rotated so as to move the object in the direction of the arrow.

The guide means consist of a tubular guide (12) open at both ends, inside which the object (11) moves along an imposed trajectory in the form of a continuous curve. The tubular guide (12) is held in place by fixing lugs (23) inside a box (24).

The tubular guide (12) includes, near one end, inlet means (21) for clean solvent medium and, near the other end, outlet means (22) for dirty solvent medium, so that the solvent medium (2) circulates in the tubular guide (12) in contact with the long, linear object (11) and in a direction opposite to the direction of movement of the object (11). The inlet means (21) can be connected to a supply of clean solvent medium, in which case the outlet means (22) for dirty solvent medium is connected to a tank for recovering the dirty solvent medium for subsequent regeneration. Preferably, the dirty solvent medium is led directly to a regenerating device (25), for example a distiller or a filter, and clean solvent medium leaving this device is reintroduced into the tubular guide (12) by the inlet means (21). This creates, in the tubular guide (12), a circulation of the solvent medium in contact with the long, linear object (11) and in the opposite direction to the direction of movement of the object in the tubular guide (12).

The tubular guide (12) is provided over part of its outer surface with heating means (4) which make it possible to bring the solvent medium (2) to a boil and to create two vapor zones (18, 19). The tubular guide (12) is provided at each end with a sleeve (20) containing means (5) for condensing the vapors of the solvent medium (2).

Ultrasonic emitters (31) are fixed to the wall of the tubular guide (12).

FIG. 2 shows the position of the long, linear object (11) in the tubular guide (12). The long, linear object (11) which is to be cleaned can be electronic components (26) soldered onto printed circuits (27), which are joined by a support (28) so as to form a strip. The edges (29, 30) of the support (28) ride against the inner surface of the tubular guide (12) when a pulling force is exerted by means of the rollers of the drawing device (8).

A variation of this embodiment which makes it possible to simultaneously clean several long, linear objects can have several tubular guides placed side-by-side with no common points, or alternatively several tubular guides joined side-by-side, with two adjacent tubular guides possessing a common wall portion. The same solvent medium can circulate through the various tubular guides, and the ends of the tubular guides which are located near the inlet and/or or outlet ramps can open into the same sleeve containing condensing means.

Alternatively, different solvent media can circulate through different ones of the tubular guides, with each tubular guide having its inlet and outlet means for solvent connected to different regenerating devices.

In the cleaning of a long, linear object using the illustrated embodiment, the means (4) for heating the solvent medium (2) are switched on until the solvent medium (2) is boiling and two vapor zones (18, 19) of the solvent medium form above its surface (14). Then, the circulation of cooling fluid is set up in the coils (5) located in the region of the ends of the tubular guide (12), so as to prevent the vapor of the solvent medium from escaping. The solvent medium (2) is circulated through the tubular guide (12), from the inlet means (21) to the outlet means (22), and the ultrasonic emitters (31) are switched on.

The long, linear object (11) is introduced successively through the inlet ramp (6), through the tubular guide (12), through the outlet ramp (7) and between the rollers of the drawing device (8). Through the rotation of the rollers of the drawing device (8), the long, linear object is moved successively through a first vapor zone (18), the hot solvent medium (2) and a second vapor zone (19) of the solvent medium, along an imposed trajectory in the form of a continuous curve.

When the long, linear object (11) passes through the first vapor zone (18), it is preheated and pre-cleaned. When it passes through the solvent medium (2), the dirt is dissolved and/or detached and the long, linear object (11) is rinsed by clean solvent medium (2), which is moving in the opposite direction. When the long, linear object (11) passes through the second vapor zone (19), it is rinsed by the trickles of condensate of the vapor.

In a variation of this embodiment, the tubular guide (12) can be partly immersed in a liquid medium in such a way that the ends of the tubular guide (12) are located above the level of the liquid medium. In this case, the liquid medium is contained in a vat placed in the box (24), the emitters (31) being fixed to the wall of the vat. The ultrasound produced by the emitters is transmitted by the liquid medium to the solvent medium (2) after it has passed through the wall of the tubular guide (12).

In the operation of this type of apparatus in which the solvent medium is subjected to ultrasound, the solvent medium (2) contained in the tubular guide (12) is preferably heated, but not brought to a boil, since the transmission of ultrasound waves is hindered by boiling. The cleaning of a long, linear object using an apparatus according to this embodiment employs both the cleaning action of the hot solvent medium and the cleaning action of the ultrasound.

Figure 4:
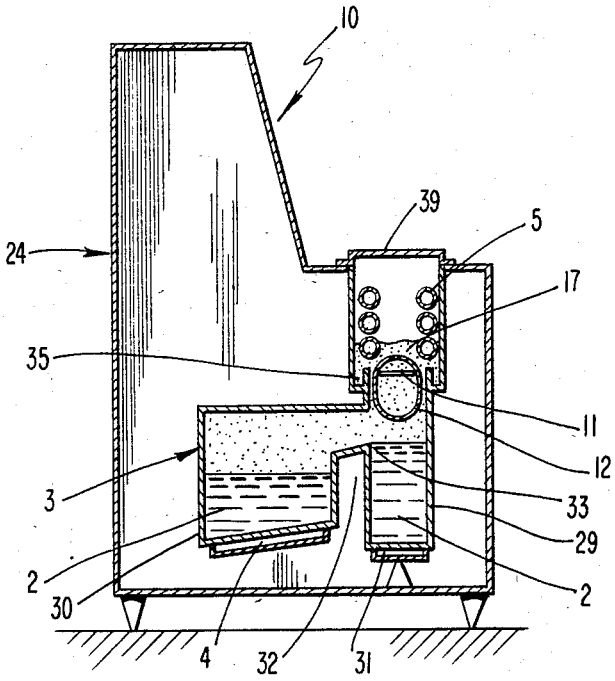
FIG. 4 is a view in section through the plane IV—IV of the apparatus shown in FIG. 3.
Figure 5:
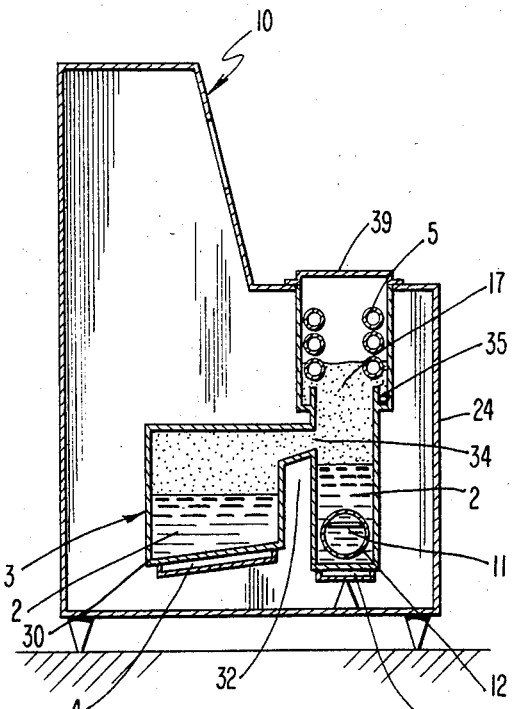
FIG. 5 is a view in section through the plane V—V of the apparatus shown in FIG. 3.

A preferred embodiment of the invention for cleaning a long, linear object in a solvent medium is shown in FIGS. 3, 4, and 5. In this embodiment, the apparatus (10) has an open vat (3) containing the solvent medium (2). In the region of its opening, the vat is provided with means for condensing the vapors of the solvent medium, which means consists of a coil (5) through which a cooling fluid passes. Although the apparatus is shown with the condensing means located at only one height from the surface of the solvent medium, the scope of the invention is not exceeded by placing condensing means at two different heights.

The vat (3) consists of two compartments (29, 30), namely a cleaning compartment (29) and a distillation compartment (30). The cleaning compartment (29) is approximately parallelepipedal in shape and it is equipped on the bottom with emitters (31). A tubular guide (12) inside which the object moves is located in the cleaning compartment (29), partly immersed in the solvent medium (2). The tubular guide (12) is provided, adjacent one end, with inlet means (21) for clean solvent medium and, at the other end, with outlet means (22) for dirty solvent medium. Thus, solvent medium (2) is circulated in contact with the object (11) and in the opposite direction to the direction of movement of the object.

The tubular guide (12) is partly immersed in the solvent medium (2) in such a way that its ends, the inlet means (21) for clean solvent medium and the outlet means (22) for dirty solvent medium are located above the surface (14) of the solvent medium (2). Further, the inlet means (21) for clean solvent medium are located at a greater height than the outlet means (22) for the dirty solvent medium, so that the solvent medium flows under gravity from one end of the tubular guide (12) to the other, circulating in contact with the long, linear object (11) and in the opposite direction to the direction of movement of the object. The dirty solvent medium flows directly into the cleaning compartment (29).

A variation of this embodiment which is adapted to simultaneously clean several long, linear objects can include, as the guide means, several tubular guides placed side-by-side with no common points or alternatively several tubular guides joined side-by-side, with two adjacent tubular guides possessing a common wall portion.

The distillation compartment (30) is provided with heating means (4), for example electrical heating means, which make it possible to bring the solvent medium (2) to its boiling point.

The dividing partition (32) between the cleaning compartment (29) and the distillation compartment has an overflow sill (33), which enables the solvent medium (2) contained in the cleaning compartment (29) to flow into the distillation compartment (30). An opening (34) enables the vapors that are generated by boiling of the solvent medium (2) contained in the distillation compartment (30) to enter the cleaning compartment (29) and to create a vapor zone (17) above the level (14) of the solvent medium (2). The partition (32) can have a uniform height equal to the height of the overflow sill.

The vapors of the solvent medium condense in the region of the coils (5) and the condensate of the vapors, which is then dirt-free solvent medium, is recovered by suitable means such as a spout (35). A pipe (36) leads the recovered condensate to a water separating device (37), which can be, for example, a separating device of the decantation type or a cartridge packed with a product which is capable of absorbing the water while allowing the solvent medium to pass through. At the outlet of the water separating device (37), a pipe (38) leads the clean solvent medium to the inlet means (21) of the tubular guide (12). This heating device can consist, for example, of a helical coil (39) in a portion of the pipe (38) that is present in the vapor zone (17) of the solvent medium.

Like the previously described embodiments, the apparatus also includes an inlet ramp (6), an outlet ramp (7) and a device (8) for drawing the long, linear object (11). If appropriate, the apparatus can also be provided with a cover, which is advantageously transparent.

In operation, after the cleaning compartment (29) and the distillation compartment (30) have been filled with solvent medium to a prescribed level, the heater (4) for the solvent medium (2) contained in the distillation compartment (30) is actuated at least until the solvent medium passes through the opening (34) in the partition (32) and creates the zone (17) above the surface (14) of the solvent medium (2) in the cleaning compartment (29). The circulation of cooling fluid is set up in the coil (5) located in the region of the opening in the vat (3), so as to condense the vapors of the solvent medium and to prevent them from escaping out of the vat (3). The condensate recovered from the spout (35) is led through the pipe (36) to the water separating device (37), and the water-free condensate, which is clean solvent medium, leaves the device (37) through the pipe (38) and is led to the inlet means (21) after it has been heated in the helical pipe (39). The solvent medium is therefore circulated continuously through the tubular guide (12), from the inlet means (21) to the outlet means (22), in the opposite direction to the direction of movement of the object (11).

The solvent medium leaving the tubular guide (12) through the outlet means (22) arrives in the cleaning compartment (29), and solvent medium escapes by flowing over the sill (33) and falls into the distillation compartment (30), where it is heated to a boil.

The ultrasonic emitters (31) are switched on, and the long, linear object (11) is introduced successively through the inlet ramp (6), through the tubular guide (12), through the outlet ramp (7) and between the drawing rollers (8). Through the rotation of the rollers of the drawing device (8), the long, linear object is moved successively through a first vapor zone [between the inlet ramp (6) and the surface of the solvent medium (2) in the tubular guide (12)], the solvent medium (2) and a second vapor zone [between the surface of the solvent medium (2) in the tubular guide (12) and the outlet ramp (7)].

By virtue of the tubular guide (12), when the long, linear object (11) is moved, it is moved along an imposed trajectory in the form of a continuous curve. When the long, linear object (11) passes through the first vapor zone, it is preheated and pre-cleaned. When the long, linear object (11) passes through the solvent medium (2), it is subjected to the cleaning action of the solvent medium, and the dirt which is insoluble in the medium is detached by the action of the cavitation of the solvent due to the ultrasound. The long, linear object (11) is rinsed by the solvent medium (2), which is moving in the opposite direction to the direction of movement of the object (11). When the object (11) passes through the second vapor zone, it is rinsed by the trickles of condensate of the vapor.

The various embodiments of the apparatus according to the invention for cleaning at least one long, linear object have been described above only by way of example, and the scope of the invention is not exceeded by combining all or part of these various embodiments with one another.

An apparatus for cleaning at least one long, linear object that incorporates the present invention has numerous advantages over the apparatuses shown in the prior art. For example, the means for guiding the object along a continuous curve make it possible to introduce the object into the apparatus with greater ease than into an apparatus equipped with rollers, because, in the latter apparatus, the operator must place the object around each roller by hand. In particular, with guide means consisting of a tubular guide, it is sufficient to introduce the long, linear object at one end and push it gradually into the guide so that it reaches the other end without risk of catching and without manual intervention in the solvent medium by the operator.

The apparatus also has the advantage of avoiding the risks of damaging the object to be cleaned.

An important advantage of the invention is the fact that the consumption of solvent medium is low while at the same time making it possible to obtain high-quality cleaning of the object. This feature is due to the circulation of clean solvent medium in the opposite direction to the direction of movement of the object, making it possible to rinse the object with clean solvent just before it leaves the solvent medium.

In some embodiments, the apparatus also makes it possible to use only a small volume of solvent medium, since it is necessary only for the tubular guide to contain solvent medium.

By virtue of its low solvent consumption, the apparatus also has the advantage of reducing the problems of pollution and of solvent regeneration.

What is claimed is:

1. An apparatus for cleaning a continuous, long, linear object in a solvent medium, comprising a tubular guide open at its ends for guiding the long, linear object, means for drawing the object inside said tubular guide along an imposed trajectory in the form of a continuous curve, said tubular guide being provided, adjacent one end thereof, with inlet means for clean solvent medium and, adjacent its other end, with outlet means for dirty solvent medium, so that the solvent medium circulates through the tubular guide in contact with the long, linear object and in the opposite direction to the direction of movement of the object through the tubular guide, and means for subjecting the solvent medium to ultrasound, further comprising a vat including a cleaning compartment and a distillation compartment, each containing solvent medium and laterally separated from each other by a dividing partition having an overflow sill and an opening for providing vapors of the solvent medium with access to said cleaning compartment, with said distillation compartment including heating means and said cleaning compartment projecting upward above the upper portion of said distillation compartment and having at each end thereof condenser coils for condensing vapors of the solvent medium, with inlet and outlet ramps for said object placed upon said condenser coils, wherein said tubular guide is partly immersed in the solvent medium in said cleaning compartment such that its ends are located above the surface of said solvent medium and under said condenser coils.

2. The apparatus according to claim 1, wherein the inlet means for clean solvent medium is at a greater height than the outlet means for dirty solvent medium and is located above the surface of the solvent medium.

3. The apparatus according to claim 1, wherein said inlet means for the clean solvent medium is connected to means for recovering the condensate of the vapors of the solvent medium.

4. The apparatus according to claim 3, further including a water separating device and a condensate heating device between the means for recovering the condensate of the vapors of the solvent medium and the inlet means for the clean solvent medium.

5. The apparatus according to claim 1, further comprising means for cleaning said dirty solvent medium, interconnected with said inlet means.

6. The apparatus according to claim 1, wherein said means for subjecting said solvent medium to ultrasound include at least one ultrasound emitter immersed in said solvent medium.

7. The apparatus according to claim 6, wherein said emitter is fixed to a wall of at least one of said vat and said tubular guide.

* * * * *